United States Patent [19]

Webb

[11] 4,167,799

[45] Sep. 18, 1979

[54] CARPET CLEANING MACHINE

[76] Inventor: Charles F. Webb, 3047 E. Greenway Rd., #2, Phoenix, Ariz. 85032

[21] Appl. No.: 904,573

[22] Filed: May 10, 1978

[51] Int. Cl.[2] ..... A47L 7/00

[52] U.S. Cl. ..... 15/320; 15/322; 15/359; 15/340

[58] Field of Search ..... 15/320, 321, 322, 355, 15/359, 340, 50 C

[56] References Cited

U.S. PATENT DOCUMENTS

| | | | |
|---|---|---|---|
| 3,402,420 | 9/1968 | Schaeffer | 15/340 X |
| 3,408,673 | 11/1968 | Oxel | 15/320 X |
| 3,550,181 | 12/1970 | Dolan et al. | 15/320 |
| 3,649,995 | 3/1972 | Ison | 15/320 |
| 3,686,707 | 8/1972 | Hughes et al. | 15/320 |
| 3,755,850 | 9/1973 | Porter | 15/320 |
| 4,006,506 | 2/1977 | Burgoon | 15/320 |

FOREIGN PATENT DOCUMENTS

| | | | |
|---|---|---|---|
| 1159057 | 7/1969 | United Kingdom | 15/320 |

*Primary Examiner*—Peter Feldman
*Attorney, Agent, or Firm*—Warren F. B. Lindsley

[57] ABSTRACT

A combination foam and steam carpet cleaning machine incorporating separate storage compartments for the hot water and the foaming liquid, automatic control of vacuum wands positioned ahead and to the rear of the steam jets to permit forward and reverse motion during the steam cleaning operation, individual height adjustments for the cleaning brush and the vacuum wand and spring loading of the vacuum wand to insure adequate pressure of the wand against the carpet for maximum vacuuming efficiency. The machine is self-propelled in both forward and reverse directions.

3 Claims, 10 Drawing Figures

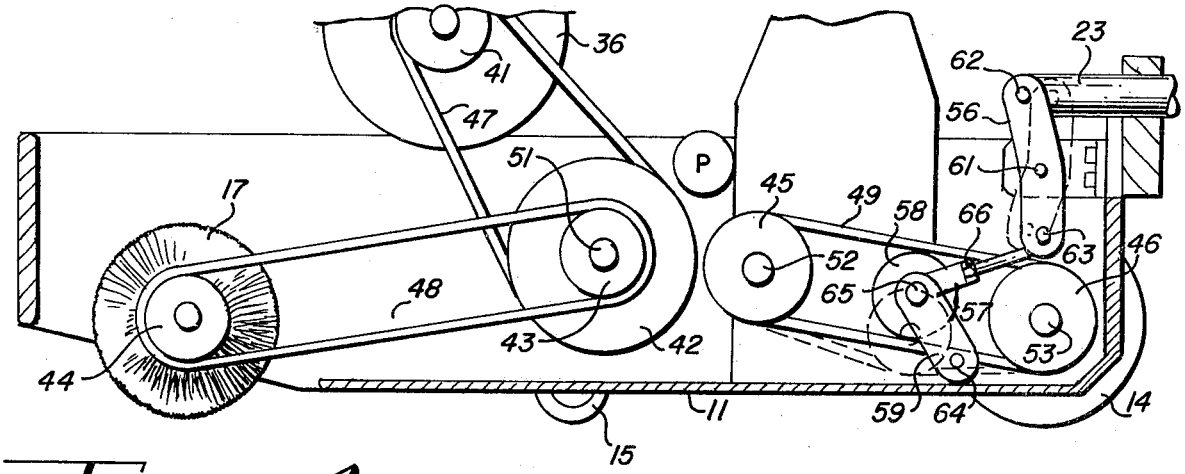
FIG. 4
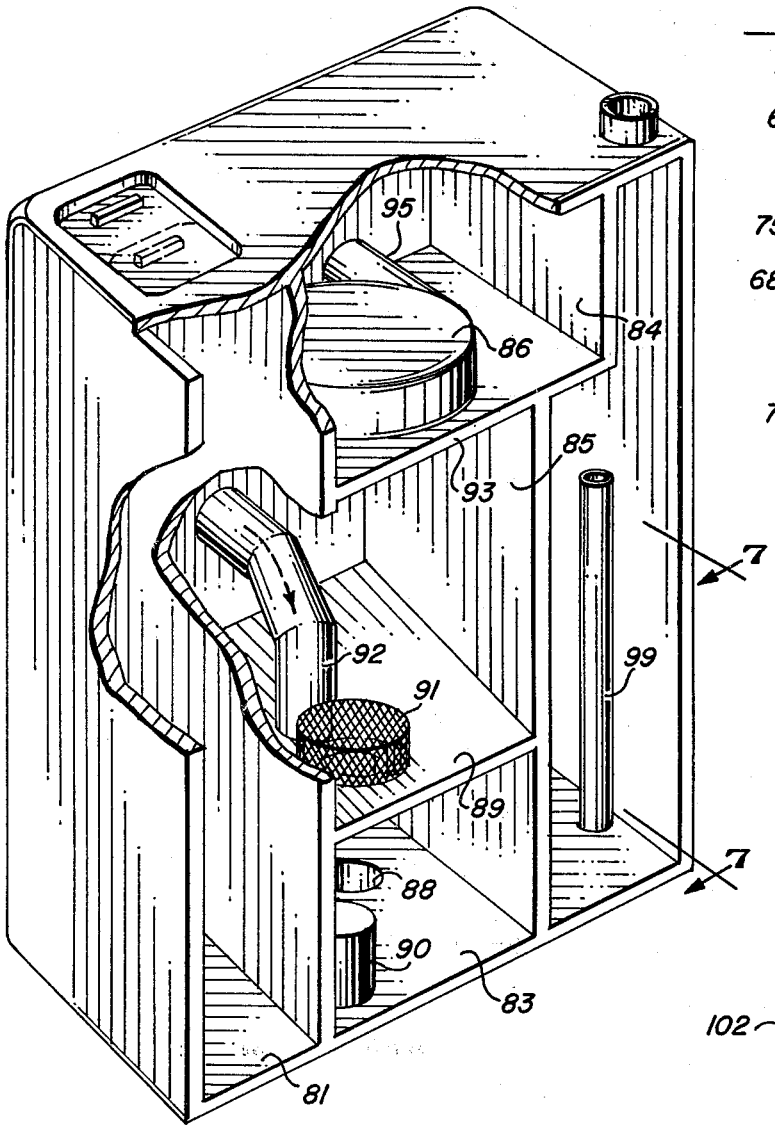
FIG. 6
FIG. 5
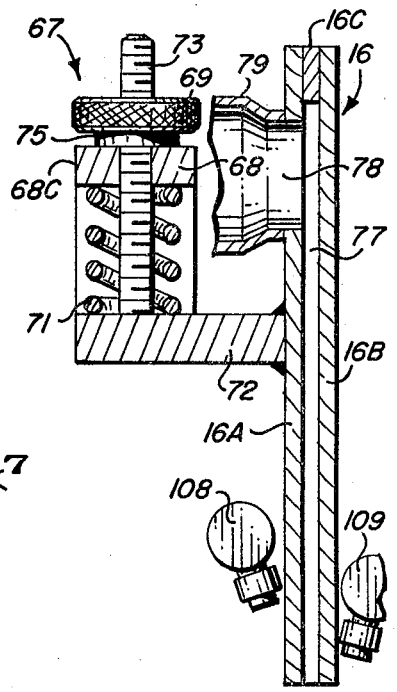
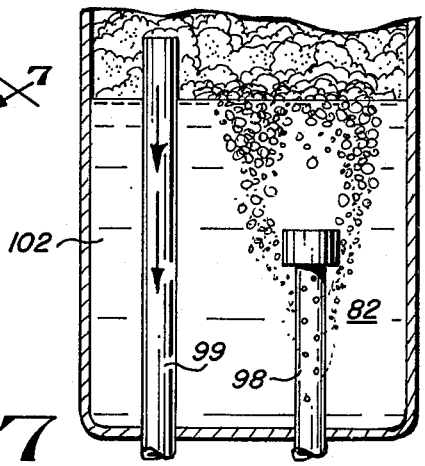
FIG. 7

CARPET CLEANING MACHINE

BACKGROUND OF THE INVENTION

Various types of carpet cleaning machines have been produced over the past several years which typically may be rented for use in the home or they may be operated by a professional carpet cleaner. The designs of such machines are based on one or more cleaning methods.

The most commonly used method of cleaning carpets has been by shampooing. This method usually consists of applying a soapy or detergent-based foam to the surface of the carpet and brushing it in with a powered brush. The carpet is then left to stand for a period of time ranging from a few hours to a day before the dried foam and entrapped soil is removed by vacuuming. Shampooing in this manner is effective in removing surface soil and stains, but it has little or no effect in removing embedded dirt and sand. Furthermore, after a carpet has been shampooed several times, it reaches a state wherein the buildup of residue from the shampoo itself is so great that this method is no longer effective.

Another method of cleaning carpets involves the discharging of pressurized "steam" (actually hot water) into the carpet and, in the same operation, removing the hot water by vacuum along with the entrained dust and dirt. This method is effective in removing deeply embedded soil, but it is only marginally effective in removing stains.

Frequently a professional carpet-cleaner will own two machines including a foam cleaner and a hot water or "steam" cleaner, and he will utilize one or both methods to clean a carpet, depending upon the condition of the carpet.

Numerous machine designs of both types are described in the prior art. Machines cleaning strictly by means of foam or shampoo are disclosed by R. R. Rockwell (U.S. Pat. No. 3,079,285), J. Wright (U.S. Pat. No. 3,364,627), L. G. Schowalter (U.S. Pat. No. 3,392,418), and Nayfa et al (U.S. Pat. No. 4,000,537). Steam or hot water carpet cleaning machines are disclosed by J. O. Jones (U.S. Pat. No. 3,614,797), Putt (U.S. Pat. No. 3,699,607), Cannan (U.S. Pat. No. 3,919,729), Cyphert (U.S. Pat. No. 3,959,844), and Silvis et al (U.S. Pat. No. 3,974,541).

In the prior art machines of both types there are such common features as motors, self-propelling drives, supporting frames, wheels, etc. for which a professional carpet cleaner must pay twice if he owns both types of machines, but because there has been no universal cleaning machines available which incorporates both cleaning methods, he has no alternative.

There is, therefore, a need for a carpet-cleaning machine which provides both cleaning methods on a single frame so that a greater degree of versatility may be provided at a lower equipment cost.

SUMMARY OF THE INVENTION

In accordance with the invention claimed, an improved carpet-cleaning machine is provided which incorporates both the foam cleaning and the steam cleaning methods.

It is, therefore, one object of this invention to provide an improved carpet-cleaning machine.

Another object of this invention is to provide in a single machine a dual capability for both foam and steam cleaning.

A further object of this invention is to provide a self-propelled carpet-cleaning machine which incorporates automatic control of the hot-water jets as appropriate to permit forward and reverse movement of the machine without interruption of the cleaning action.

A still further object of this invention is to provide in such a machine independent height adjustments of the vacuum wand and the cleaning brush.

A still further object of this invention is to provide positive pressure of the vacuum wand against the carpet in order to achieve a highly effective vacuuming action.

A still further object of this invention is to provide in the design of the waste and vacuum tanks means for trapping the foamy waste water and thereby preventing it from being drawin into the vacuum motor.

Yet another object of this invention is to provide a special means for mounting the liquid storage tanks on the upright handle of the machine with means for locking its position.

Further objects and advantages of the invention will become apparent as the following description proceeds and the features of novelty which characterize this invention will be pointed out with particularity in the claims annexed to and forming a part of this specification.

BRIEF DESCRIPTION OF THE DRAWING

The present invention may be more readily described by reference to the accompanying drawing, in which:

FIG. 4 is a cross-sectional view of the lower portion of the machine of FIG. 1 as seen along line 4—4 of FIG. 1;

FIG. 5 is fragmented cross-sectional view of the vacuum wand height adjustment mechanism as seen along line 5—5 of FIG. 3;

FIG. 6 is a perspective view of the fluid storage and vacuum tank of the machine of FIGS. 1-5 with the outer wall partially cut away to reveal details of its interior construction;

FIG. 7 is a partial cross-sectional view of the tank of FIG. 6 as seen along line 7—7 of FIG. 6;

DESCRIPTION OF THE PREFERRED EMBODIMENT

Figure 1:
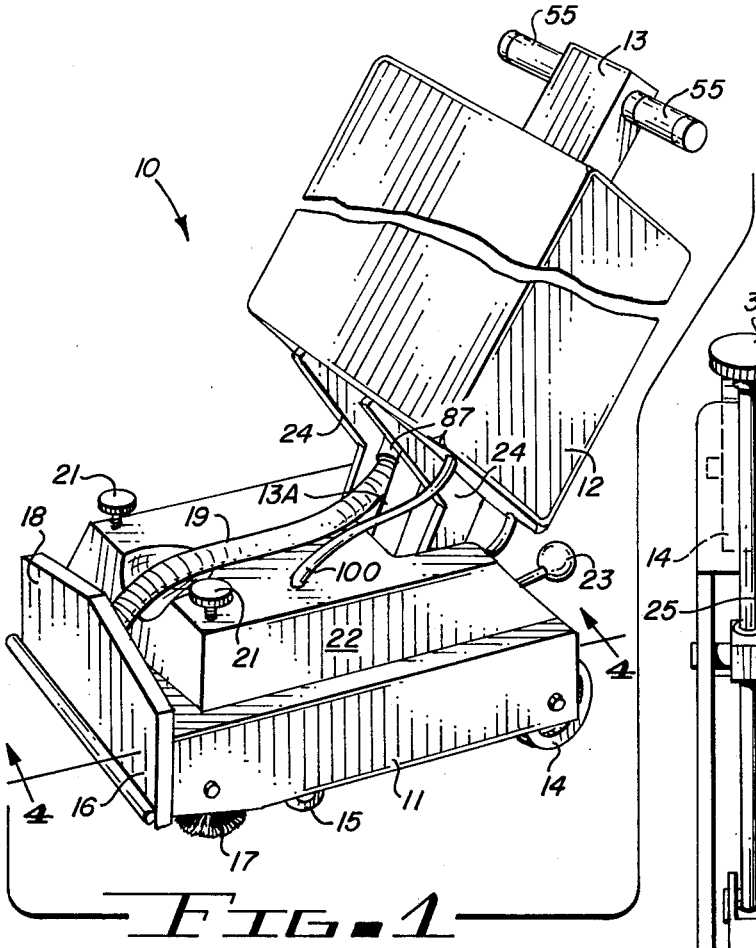
FIG. 1 is a perspective view of the improved carpet-cleaning machine of the invention.

Referring more particularly to the drawing by characters of reference, FIG. 1 discloses the improved carpetcleaning machine 10 of the invention comprising a chassis or frame 11, a fluid storage and vacuum tank 12 mounted on a heavy pivoting handle 13 which rises at an angle from the rear of the chassis 11, heavy rear roller-type wheels 14, smaller front support roller type wheels 15, a vacuum wand 16 positioned at the front of the chassis 11, and a rotating cleaning brush 17 which is mounted just rearward of the wand 16 and forward of the rollers 15. A hot water jet manifold 18 is mounted along the lower edge of the front face of wand 16 and a vacuum hose 19 connects the wand 16 to the tank 12. Two screw-type adjustment knobs 21 projecting from the top surface of the housing 22 serve for the adjustment of the height of the wand 16. A clutch lever 23 for the disengagement of the rear wheels 14 extends from the rear of the housing 22.

Figure 3:
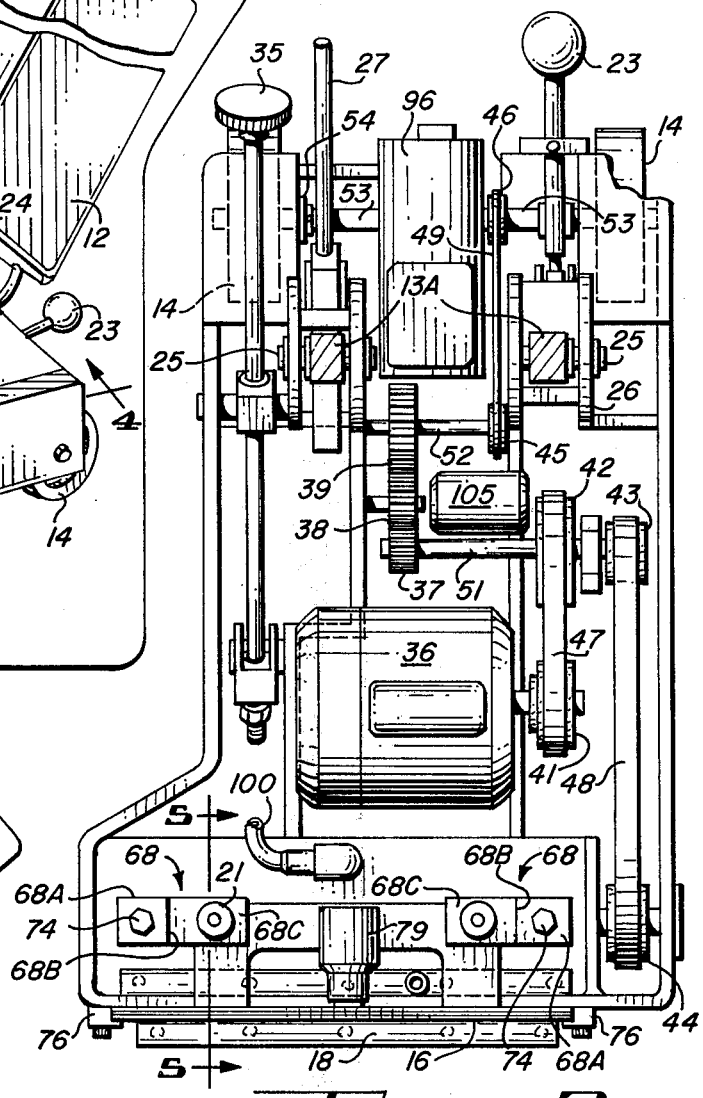
FIG. 3 is a top view of the lower portion of the machine of FIG. 1 with the cover or housing removed to expose the working parts.
Figure 2:
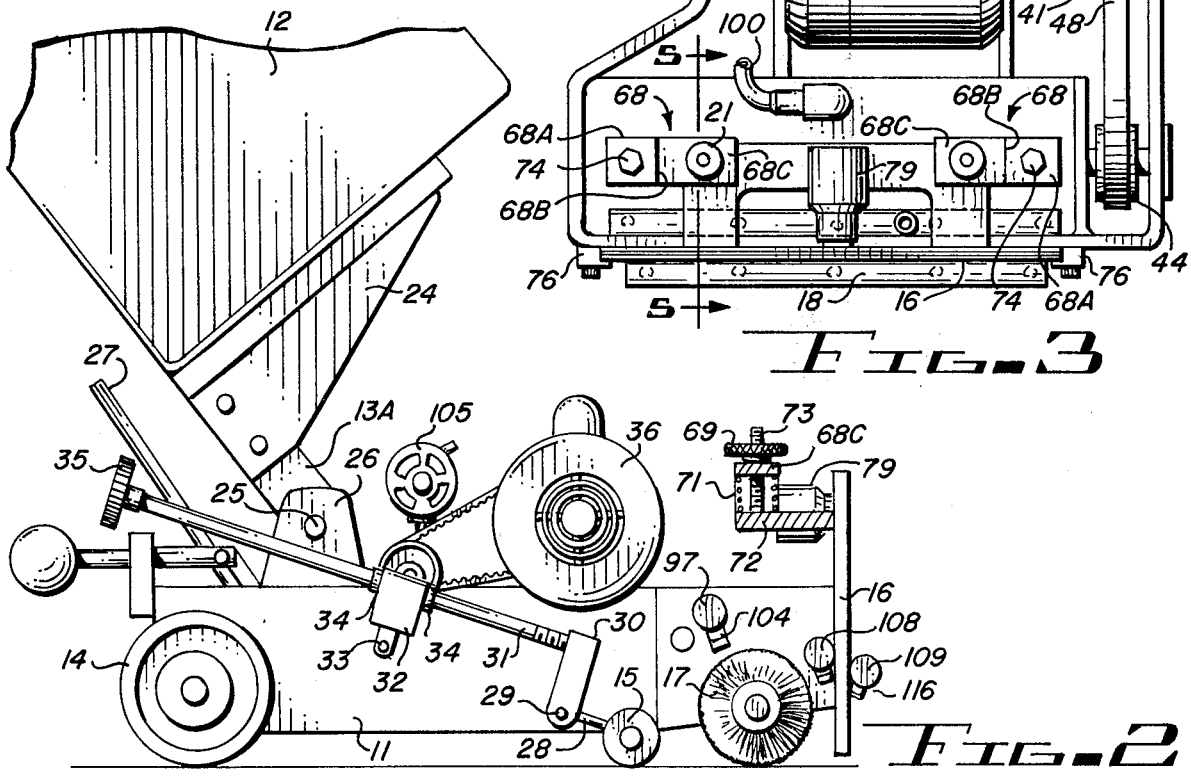
FIG. 2 is an opposite side view of the machine of FIG. 1.

The handle 13 incorporates two heavy longitudinal bars 13A which are also seen in FIG. 2 and in cross-section in FIG. 3. Two triangular brackets 24 attached to bars 13A and extending forward therefrom serve as base supports for the tank 12. The rear wall of tank 12 is secured to the upper or forward surface of the handle 13. The bars 13A are pivotally mounted by means of pivot pins 25 to tabs 26 which extend upwardly from the chassis 11. A tank angle locking lever 27 secures the handle 13 in any desired pivotal position.

The incomplete side view of FIG. 2 shows the mounting of the front support rollers 15 to the chassis 11. The rollers 15 are mounted at the end of an L-shaped bracket 28 which is pivotally secured at its center 29 to the chassis 11. A threaded collar 30 at the end of the other leg of the bracket 28 is engaged by the threaded end of a long adjustment screw 31. The unthreaded main body of the screw 31 passes through a collar 32 which is also pivotally secured to the chassis 11 by means of a pivot pin 33. The screw 31 is free to rotate within collar 32 but relative longitudinal motion therein is prevented by clips 34 secured to screw 31 at both ends of collar 32. A hand grip 35 for turning screw 31 is secured to the unthreaded end of screw 31 which extends rearwardly from the rear end of chassis 11. It will now be evident from FIG. 2 that as grip 35 and screw 31 are rotated so that collar 30 is taken up by the threaded end of screw 31, the bracket 28 is rotated about point 30 and roller 15 is raised or lowered relative to chassis 11 so that the chassis 11 is lowered or raised relative to the floor surface.

Mounted on chassis 11 is an electric motor 36 which propels the brush 17 and the rear wheels 14. Associated with the motor 36 in these functions are speed reduction gears 37, 38 and 39, pulleys 41–46, and belts 47–49. Pulley 41 is fixed to the shaft of motor 36 and pulley 44 is fixed to the shaft of brush 17. Pulleys 42 and 43 and gear 37 are fixed to a common shaft 51 which is rotatably mounted to chassis 11. Gear 38 is an idler which is rotatably mounted to chassis 11. Gear 39 and pulley 45 are fixed to a common shaft 52 which is rotatably mounted to chassis 11, while pulley 46 and rear wheels 14 are fixed to the rear axle 53 which is mounted by means of wheel bearings 54 to chassis 11.

Pulleys 41 and 42 are coupled by belt 47, pulleys 43 and 44 are coupled by belt 48, pulleys 45 and 46 are coupled by belt 49, and gears 37, 38 and 39 are serially engaged.

Shaft 51 is turned by motor 36 by virtue of the coupling effected by belt 47 working in pulleys 41 and 42. Because pulley 41 is smaller than pulley 42, the speed of shaft 51 is somewhat less than that of motor 36. A further reduction in speed is achieved in the coupling of shaft 51 to the brush 14 by belt 48 working in pulley 43 and the somewhat larger pulley 44. Gears 37, 38 and 39 are progressively larger in the order listed so that a reduction in speed and an increase in torque or mechanical advantage is achieved between shaft 51 and shaft 52. Shaft 52 is coupled to rear axle 53 through belt 49 working in pulleys 45 and 46. Motor 36 is electrically reversible by means of switch contacts coupled to control handle bars 55. Thus, as bars 55 are rotated clockwise the motor 36, the brush 17 and the wheels 14 turn in a given direction, and they turn in the opposite direction when the bars 55 are rotated counter-clockwise. In the center or rest position of the bars 55 the motor 36 is de-energized.

The rear wheels 14 may be independently decoupled from motor 36 by means of a clutch assembly including the clutch lever 23, a rocker arm 56, an adjustable coupling arm 57, a clutch pulley 58, and a pivoting pulley support arm 59. Rocker arm 56 is pivotally supported to chassis 11 at its center by means of a pivot pin 61. The upper end of arm 56 is pivotally connected to clutch lever 23 by a pin 62, and the lower end of arm 56 is coupled to the upper end of arm 57 by a pivot pin 63. The lower end of arm 59 is pivotally coupled to chassis 11 by a pivot pin 64 and the upper end of arm 59 carries rotatably the shaft 65 which also serves as a pivot pin coupled to the lower end of arm 57. The length of arm 57 is adjustable by means of a threaded turn-buckle 66.

In the position shown in solid lines for clutch lever 23 and the other elements of the clutch assembly the pulley 58 is not in contact with the belt 49. The belt 49 is thus slack and does not forcibly engage the pulley 46 to drive the rear wheels 14. To engage the rear wheels, the clutch lever 23 is pulled rearward rocking arm 56 clockwise so that arm 57 is driven to the left and pulley 58 is pivoted left-ward into engagement with belt 49. The slack in belt 49 is thus taken up so that it engages pulleys 45 and 46 to drive wheels 14 and thereby to propel the machine 10.

Shown in FIG. 5 and also in FIGS. 2 and 3 are the wand 16 and the wand adjustment mechanism 67. The mechanism 67 comprises two stair-step support brackets 68, two knurled adjustment nuts 69, a compression spring 71, a pair of horizontal support tabs 72 extending perpendicularly rearward from the vertical rear surface of the vacuum wand 16, and two threaded studs 73, one each extending vertically upward from each of the tabs 72.

Each of the stair-step brackets 68 has a lower and an upper horizontal step 68A and 68C, respectively, joined by a vertical riser, 68B. Each bracket 68 is secured to the chassis 11 by means of a machine bolt 74 which passes through a hole in step 68A. One bracket 68 is positioned at the left and one at the right side of the chassis, immediately rearward of the wand 16.

Each of the studs 73 is aligned with a clearance hole in one of the upper steps 68C and passes first through one of the springs 71, then through the clearance hole, through a washer 75 and is finally capped by one of the nuts 69. The springs 71 thus urge the tab 72 and the wand 69 downward to a limit position determined by the threaded position of the nut 69 on the stud 73. As seen in FIG. 3 the left and right edges of the wand 16 are confined in slots formed by edge-covering brackets 76. The brackets 76 hold the wand 16 vertical but allow its vertical movement under the indulgence of the spring 71. In use, the nuts 69 are adjusted sufficiently upward that the carpet surface rather than the nuts 69 bear the thrust of the spring 71. Employed in this manner, the mechanism 67 provides as much as one hundred pounds pressure to the carpet surface. The high pressure thus provided assures an effective seal for the wand 16 and greatly enhances the efficiency of the vacuuming operation.

The wand 16 comprises two parallel plates 16A and 16B as seen in FIG. 5 separated by a spacer 16C which extends around the top and side edges of the plates 16A and 16B leaving the bottom edges open in the area that passes over the carpet. The open space 77 between the plates 16A and 16B communicates with a circular opening 78 near the top center of the rearward plate 16A to which is affixed a vacuum hose adaptor 79.

The fluid storage and vacuum tank 12 comprises a rectangular tank which is divided into five interior compartments including left-hand and right-hand compartments 81 and 82, respectively, as viewed from the front of the machine in FIG. 6, and lower, upper and center compartments 83, 84 and 85, respectively. Compartment 81 provides storage for clean hot rinse water, compartment 82 stores the foaming liquid, compartment 83 retains the soiled water returned by the vacuum wand, compartment 85 is the "dry" vacuum chamber and compartment 84 houses the vacuum pump 86.

Figure 8:
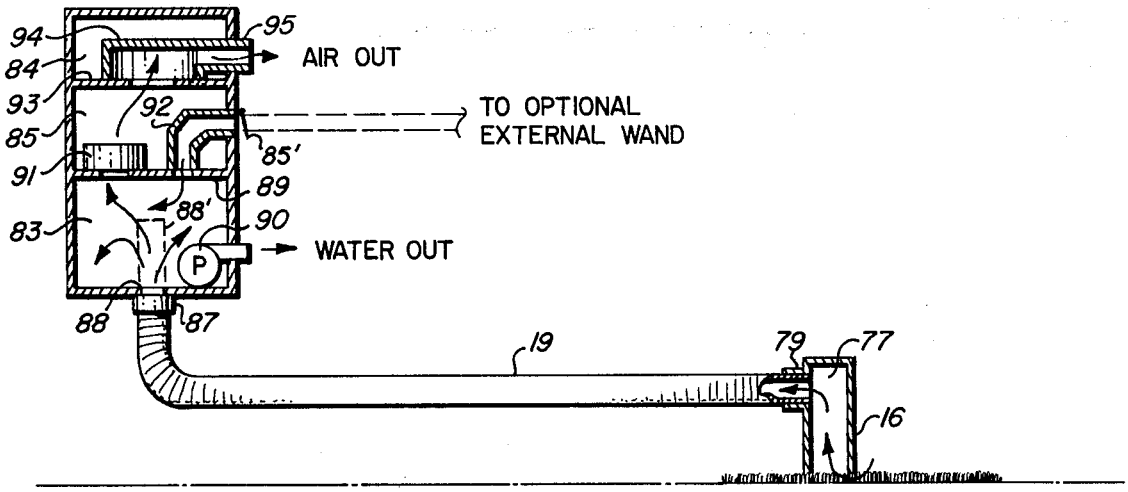
FIG. 8 discloses diagrammatically the vacuum system of the machine disclosed in FIG. 1.

The vacuum system of machine 10, as shown diagrammatically in FIG. 8, utilizes the wand 16, compartments 83, 84 and 85 of tank 12 and the vacuum hose 19 which is connected between adaptor 79 and a similar adaptor 87 which is affixed to and opens into the floor of compartment 83 through stand pipe 88' and opening 88. Compartments 83 and 85 are separated by a horizontal wall 89 in which are provided two circular openings. Over one of these openings is placed a wire mesh filter 91. Over the other is fitted a chimney 92 which passes through the rear wall of compartment 85 for connection to an optional external vacuum hose and portable vacuum wand. In the normal use of the machine 10, the chimney 92 is capped off at the point of connection of the external vacuum hose or wand by suitable means such as a flap valve 85'. Over a centered hole in the horizontal wall 93 which divides compartment 84 from 85, is positioned the vacuum pump 86. The exhaust 95 of pump 86 passes through a hole in the rear wall of compartment 84.

In the operation of the vacuum system, the pump 86 establishes a vacuum in compartments 83 and 85, in the hose 19 and in the space 77 inside wand 16. The vacuum draws in water and entrained dirt from the carpet which passes through hose 19 into compartment 83. Most of the water falls out into compartment 83. A major part of the remainder of the air-carried moisture is blocked by the filter 91 as the substantially unladened air passes on into compartment 85 where turbulence frees most of moisture residue from the air stream before the final exit through the vacuum pump 86. The successive stages of moisture removal spares the pump 86 from excessive moisture logging, thereby enhancing its efficiency and prolonging its life. A water pump 90 located in compartment 83 removes waste water and sends it through an external hose to a point of collection or disposal.

Figure 9:
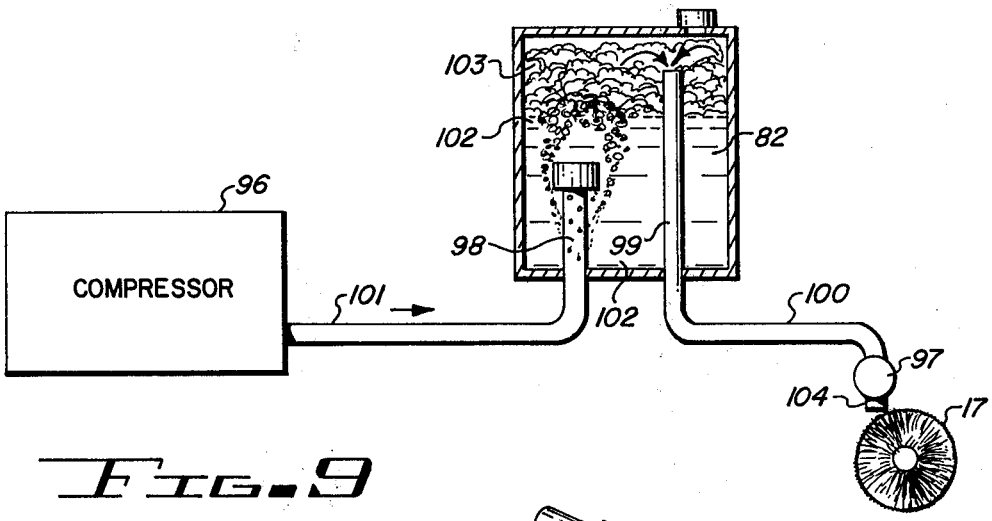
FIG. 9 discloses diagrammatically the foaming system of the machine disclosed in FIG. 1.

The foaming system of machine 10, as shown diagrammatically in FIG. 9, utilizes compartment 83 of tank 13, an air compressor 96 mounted at the rear center of chassis 11, a foam jet manifold 97, a foam delivery hose 100 connecting compartment 82 to manifold 97, and an air hose 101 which connects the output of compressor 96 to compartment 82. As shown in FIGS. 7 and 9 and in part in FIG. 6, two tubes extend upward from the base of compartment 82. The first of the two tubes is a short bubbler stack 98 and the second is a relatively longer foam collector tube 99. The compartment 82 is filled to a level below the top of tube 99 and above the top of stack 98 with a supply of a foaming liquid 102. The air hose from compressor 96 is attached to the bottom of stack 98 and the foam delivery tube is attached to the bottom of tube 99. The foam jet manifold 97 is positioned over the brush 17.

In the operation of the foaming system, the compressor 96 supplies compressed air through hose 101 to bubbler stack 98. The air emerges through holes in stack 98 and rises turbulently through the foaming liquid 102 forming a concentration of foam 103 on the surface of the liquid 102. The foam 103 covers the top of tube 99 and is carried down tube 99 with the pressurized escaping air supplied by compressor 96. The foam carried down tube 99 is delivered through hose 100 to manifold 97 and is discharged by jets 104 over the rotating brush 17. Brush 17 works the foam into the surface of the carpet being cleaned.

Figure 10:
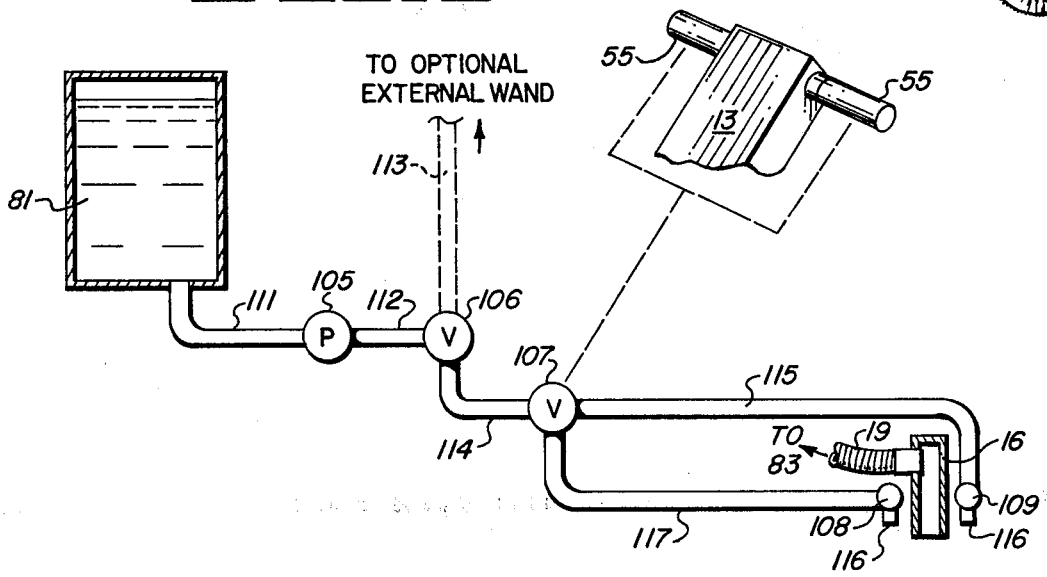
FIG. 10 discloses the steam or rinsing system of the machine disclosed in FIG. 1.

The machine 10 also incorporates a steam or rinsing system as shown in FIG. 10, the steam system comprising compartment 81 of tank 12, a water pump 105, a manually-operated valve 106, a solenoid-operated valve 107, and two steam manifolds, 108 and 109. The pump 105 draws hot water from compartment 81 through a hose 111 and sends it through a hose 112 to valve 106. Valve 106 may be set to divert the water through an external hose 113 to an optional external wand or it may be set to deliver the water through hose 114 to solenoid valve 107. Valve 107 is controlled by means of microswitches located in the control handle bars 55 of handle 13. As the handle bars 55 are rotated in one direction to initiate forward motion of the machine 10 a first microswitch is actuated which energizes valve 107 in a first mode which causes valve 107 to deliver hot water through hose 115 to manifold 109 which is positioned ahead of wand 16. The hot water is thus discharged through jets 116 to the carpet and as the machine 10 moves forward the wand 16 picks up the discharged water along with the entrained dirt and the dirty water is delivered through hose 19 to compartment 83. When the handle bars 55 are rotated in the opposite direction to initiate reverse motion of the machine 10, a second micro-switch is actuated which energizes valve 107 in a second mode which causes valve 107 to deliver hot water through hose 117 to manifold 108 which is positioned behind wand 16. The water in this case is thus deposited on the carpet to the rear of wand 16 and is picked up by wand 16 as the machine 10 moves rearward. In the rest position of the handle bars 55, the water pump 105 is de-energized and no water is delivered to wand 16.

The vacuum system, the foam system and the steam system are controllable individually so that in the normal procedure the vacuum system and the steam system are de-activated while the foaming system is utilized and the foaming system is de-activated while the steam and vacuum systems are utilized. Typically, the foam is first applied and is brushed into the surface of the carpet by brush 17. The brushing action breaks loose some of the dirt and stain as the foam is applied. The foam covered carpet is then left to stand for a period of time so that the foam may soak into the fibers and dissolve the remaining soil and stain. With the foaming system turned off, the steam (or hot water) and vacuum systems are then turned on and the machine 10 is then utilized to rinse and vacuum dry the carpet. The pressurized wand 16 is especially effective in the removal and drying operation.

The total cleaning operation including foaming and steam cleaning are thus seen to be accomplished in a single machine 10 in accordance with the stated objects of the invention, and although but a single embodiment of the invention has been illustrated and described, it will be apparent to those skilled in the art that various changes and modifications may be made therein without departing from the spirit of the invention or from the scope of the appended claims.

What is claimed is:

1. An apparatus for cleaning floor surfaces including carpets comprising:

a frame having a handle extending generally obliquely therefrom, a generally cylindrical brush with bristles rotatably mounted to said frame to engage the floor surface for rotation about a horizontal axis, a hollow wand having an open end mounted to said frame and arranged to extend juxtapositioned to and longitudinally of said brush, said wand being connected to a vacuum generating means on said frame, a first manifold defining a plurality of nozzles carried by said frame juxtapositioned to and longitudinally of said wand on one side thereof, said nozzles of said first manifold being positioned to spray fluid toward the floor surface near the engagement of the open end of said wand with the floor surface, a selectively movable bracket means mounted on said frame for adjustably mounting said wand relative to the floor surface, spring means bearing at one end against said wand and at the other end against said bracket for applying pressure to said wand to force it against the floor surface in order to achieve an effective contact of the open end of said wand with the floor surface for increasing the vacuum cleaning action of said wand on the floor surface, means for connecting said nozzles of said first manifold selectively to a source of cleaning fluid on said frame, a second manifold defining a plurality of nozzles carried by said frame juxtapositioned to and longitudinally of said brush, said nozzles of said second manifold positioned to spray a cleaning solution on said brush at a point spaced from its engagement with the floor surface, means for selectively spraying a cleaning solution from said nozzles of said second manifold on said brush and the spray fluid from said nozzles of said first manifold on the floor surface, a third manifold comprising a plurality of nozzles carried by said frame juxtapositioned to and longitudinally of said wand on the other side thereof for spraying said fluid toward the floor surface, and means connected to said wand for collecting the liquid and debris drawn off of the floor surface.

2. The apparatus set forth in claim 1 in further combination with:

a pair of reservoirs mounted on the handle of said frame, one of said reservoirs provided for containing the spray fluid for said first manifold, the other of said reservoirs provided for containing the cleaning solution for said second manifold, an air compressor mounted on said frame, means for actuating said compressor, and means for directing the compressed air from said compressor through said other of said reservoirs for foaming the cleaning solution before it is discharged out of the nozzles of said second manifold.

3. The apparatus set forth in claim 1 in further combination with:

filtering means connected to said collection means for separating the liquid and debris from the air drawn in through said wand.

* * * * *